US006222322B1

(12) United States Patent
Stack

(10) Patent No.: US 6,222,322 B1
(45) **Date of Patent: *Apr. 24, 2001**

(54) BALLAST WITH LAMP ABNORMAL SENSOR AND METHOD THEREFOR

(75) Inventor: Tom Stack, Troy, MI (US)

(73) Assignees: Q Technology Incorporated, San Fernando, CA (US); New Anthony, Inc., Canton, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/925,931

(22) Filed: Sep. 8, 1997

(51) Int. Cl.[7] ..... H05B 37/02
(52) U.S. Cl. ..... 315/119; 315/127; 315/225
(58) Field of Search ..... 315/225, 127, 315/119, 307, 224, DIG. 5

(56) References Cited

U.S. PATENT DOCUMENTS

| | | | | |
|---|---|---|---|---|
| 4,370,600 | * | 1/1983 | Zansky | 315/244 |
| 4,382,212 | * | 5/1983 | Bay | 315/225 |
| 4,398,126 | * | 8/1983 | Zuchtriegel | 315/127 |
| 4,461,980 | * | 7/1984 | Nilssen | 315/225 |
| 4,501,992 | * | 2/1985 | Evans et al. | 315/122 |
| 4,667,131 | * | 5/1987 | Nilssen | 315/275 |
| 5,089,753 | * | 2/1992 | Mattas | 315/324 |
| 5,321,337 | * | 6/1994 | Hsu | 315/219 |
| 5,394,062 | * | 2/1995 | Minarczyk et al. | 315/129 |
| 5,451,845 | * | 9/1995 | Ribarich | 315/225 |
| 5,493,180 | * | 2/1996 | Bezdon et al. | 315/91 |
| 5,635,799 | * | 6/1997 | Hesterman | 315/127 |
| 5,636,111 | * | 6/1997 | Griffin et al. | 363/37 |
| 5,650,694 | * | 7/1997 | Jayarman et al. | 315/225 |

* cited by examiner

*Primary Examiner*—David Vu
(74) *Attorney, Agent, or Firm*—Henricks, Slavin & Holmes

(57) ABSTRACT

A ballast circuit is provided having an input, an output for coupling to an electric discharge lamp and an oscillation circuit for illuminating the lamp. A circuit may be included for sensing when current from the isolation circuit exceeds acceptable levels, at which point, the ballast circuit may be shut down, limited or otherwise reducing the possibility of ballast failure. In one form of the invention, a current excursion sensor circuit is coupled between the isolation circuit and the output circuit for sensing when the current from the isolation circuit exceeds a given value. Preferably, the ballast circuit is shut down and maintained inactive until such time as any current excursion has a chance to decay away, ballast components have an opportunity to cool off or otherwise return to normal condition or until such other condition has occurred. Preferably, the ballast is shut down upon a current or voltage excursion of such a magnitude at or before components may overheat or begin to fail.

14 Claims, 5 Drawing Sheets

BALLAST WITH LAMP ABNORMAL SENSOR AND METHOD THEREFOR

FIELD OF INVENTION

This invention relates to electronic ballasts.

BACKGROUND OF THE INVENTION

Gas discharge lamps such as fluorescent lamps require ballast in order to properly start and maintain lamp ignition to produce adequate light from the lamp. Ballast may be of electromagnetic, electronic or solid state types. With newer lamps, electronic ballast have been required in order to provide the necessary voltage and current to start the lamp and to maintain the required light output.

As a fluorescent lamp ages, several things can occur. For example, an emissive coating on the lamp filament may become depleted to the point the voltage drop from the filament to the arc stream is significantly increased because ionization of the gas in the lamp decreases due to the decrease in filament electron production. This causes the ballast to increase the voltage across the filament in an attempt to increase the current through the lamp in trying to provide the power apparently required by the lamp. As a result, switching devices commonly found in electronic ballast circuits may overheat and fail.

In another example, a lamp may become deactivated, wherein the gas fill of the lamp is either dissipated during use or was not present in sufficient amounts to efficiently fire the lamp. Even though the filaments of the lamp are acceptable, the lamp does not properly fire. The lamp no longer exhibits the necessary resistance to maintain the desirable impedance in the circuit, thereby presenting a relatively low impedance to the ballast. A low impedance permits a relatively high current to be generated in the ballast components, applying a high voltage and current to the lamp filaments. The ballast components operating at such high power levels may overheat and fail.

Some electronic ballast may incorporate circuits to minimize or eliminate the possibility of component damage due to lamp failure. However, such circuits may be relatively expensive, include a relatively large number of components, or may require resetting the ballast before the ballast can again begin operation.

SUMMARY OF THE INVENTION

A ballast is provided herein which includes a circuit, component or method for detecting and/or protecting a ballast or its components from abnormal or undesirable lamp conditions. The ballast according to the present invention may include a circuit which is more simple and lower in costs than other ballast, and more reliable. In one form of the invention, the ballast can be restarted without having to be reset, and may include a suitable protective delay in restarting to minimize the possibility of components overheating or failing.

In one form of the invention, a ballast circuit is provided having an input, an output for coupling to an electric discharge lamp and an oscillation circuit for illuminating the lamp. A circuit may be included for sensing when current from the oscillation circuit exceeds acceptable levels, at which point, the ballast circuit may be shut down, limited or otherwise reducing the possibility of ballast failure. In one form of the invention, a ballast protection circuit or, more specifically, a current excursion sensor circuit is coupled between the oscillation circuit and the output circuit for sensing when the current from the oscillation circuit exceeds a given value. Preferably, the invertor circuit is shut down and maintained inactive until such time as any current excursion has a chance to decay away, ballast components have an opportunity to cool off or otherwise return to normal condition or until such other condition has occurred. Preferably, the ballast is shut down upon a current or voltage excursion of such a magnitude at or before components may overheat or begin to fail.

In one form of the invention, a sensor circuit includes a silicon5 controlled rectifier (SCR) for stopping, interrupting or shunting current in the ballast in order to shut the ballast down. Where the oscillation circuit includes switching transistors, the SCR can turn off one or both of the transistors to shut off the ballast. A capacitor may be included in the sensor circuit to help control the SCR, and may also provide a delay for preventing the ballast from restarting before conditions approach normal.

In another aspect of the invention, a ballast circuit is provided herein comprising an output circuit for producing a lamp drive current used for driving an electric discharge lamp; and a ballast protection circuit for protecting the output circuit from excessive lamp drive current that includes a current sensing resistor for producing across it a current sense voltage that varies as a function of the lamp drive current; and a device responsive to the current sensing voltage for causing the output circuit from producing the lamp drive current when the current sense voltage exceeds a predetermined voltage level indicative of excessive lamp drive current.

In yet another aspect of the invention, a method of protecting a ballast circuit from generating a lamp drive current that is excessive is provided herein, comprising the steps of sensing a current sensing voltage across a current sensing resistor that varies as a function of the lamp drive current; and preventing the ballast circuit from generating said lamp drive current if the current sensing voltage is within a predetermined voltage range indicating that an excessive lamp drive current exists.

DETAILED DESCRIPTION OF PREFERRED EMBODIMENTS OF THE INVENTION

Fluorescent lamps are used in many applications for providing lighting for commercial buildings, houses, warehouses, parking lots and other applications. One particular application of interest to the invention is the illumination of refrigeration systems. A fluorescent lamp driving circuit, typically termed a ballast, is usually employed in conjunction with the lamp to provide it a lamp drive current for causing the lamp to start illuminating, and to keep the lamp illuminated during normal operations.

Figure 1:
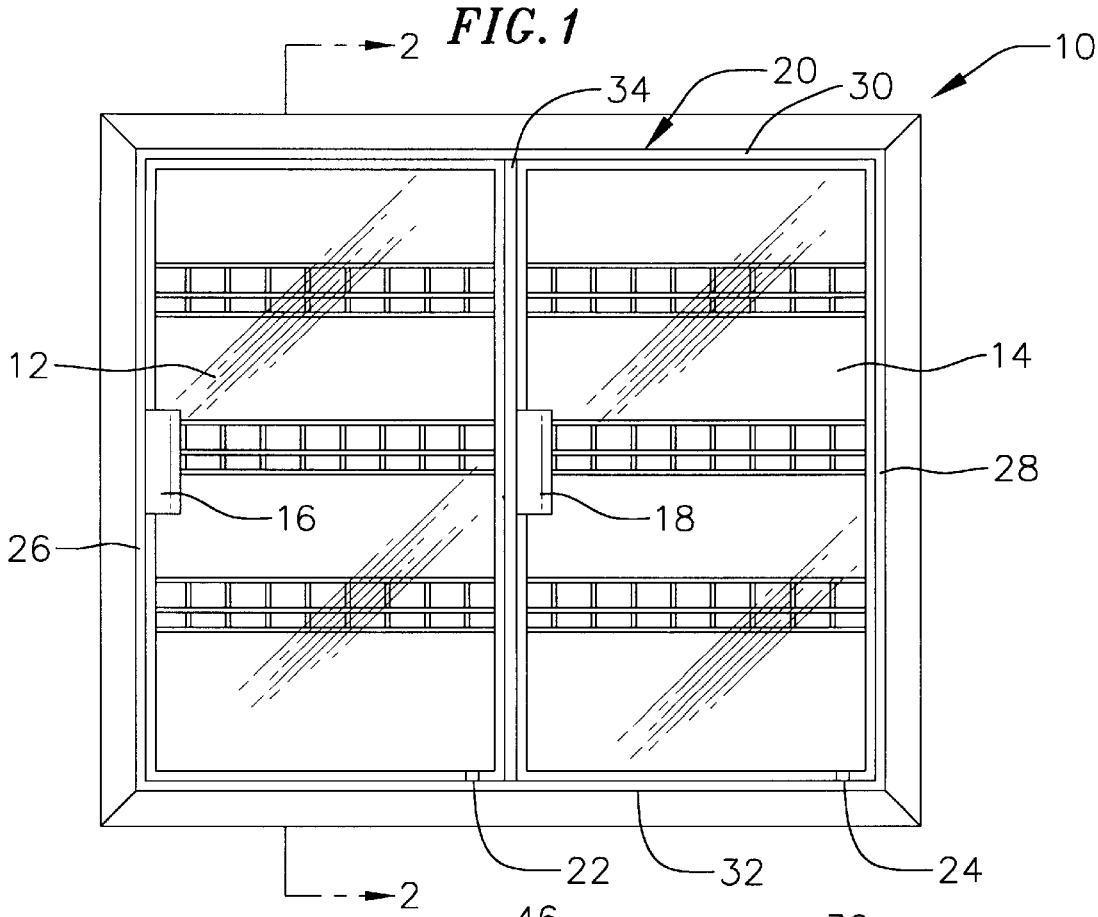
FIG. 1 is a front elevation of a refrigeration unit as per an aspect of the invention.

FIG. 1 illustrates one example of a refrigeration unit 10 which may be used in conjunction with, or from an element of, the present inventions. The refrigeration unit may be either a stand alone unit or a "built-in" unit. The refrigeration unit includes a pair of doors 12 and 14 which include handles 16 and 18, respectively. The doors 12 and 14 are pivotally mounted on a frame 20 by hinges 22 and 24. Frame 20 is secured to an opening in the refrigeration unit and consists of a pair of side members 26 and 26, a top member 30 and a bottom member 32. The frame may also include a mullion 34. Although not shown, a wire way may be associated with mullion 34, as well as other elements of frame 20, to provide passage for electrical wiring that is connected to the ballast.

Figure 2:
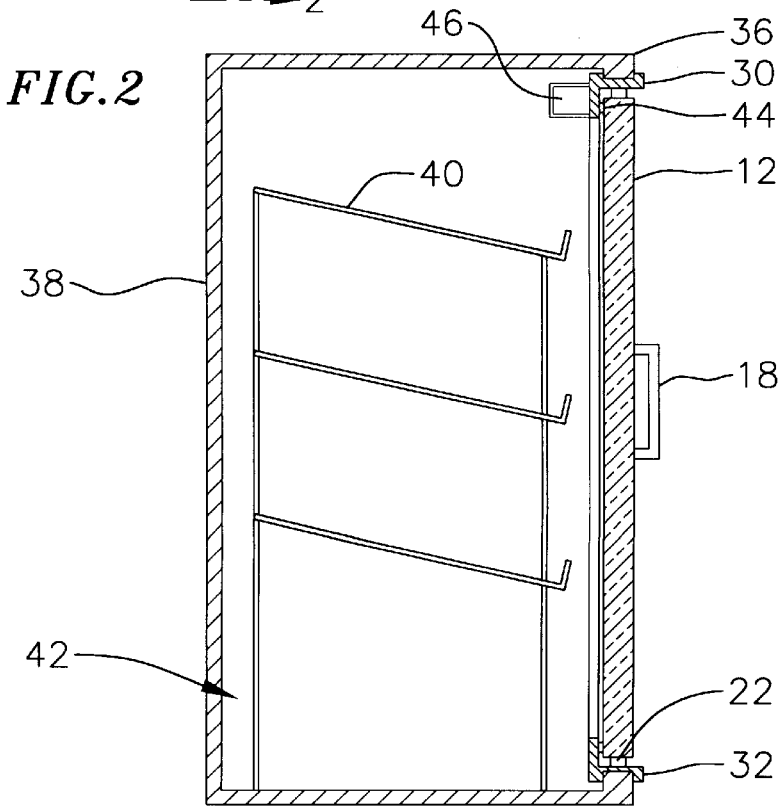
FIG. 2 is a section view taken along line 2—2 in FIG. 1.

Turning to FIG. 2, exemplary refrigeration unit 10 may also include a front wall 36, a rear wall 38 and a shelving unit 40 disposed therebetween. The shelving unit's shelves may be slightly slanted, as shown, or horizontal. Additionally, the space between shelving unit 40 and rear wall 38 (indicated by reference numeral 42) may be larger enough to allow a person to pass through. A magnetic gasket-type seal 44 is also provided between the doors 12 and 14 and frame 20 to prevent cold air from escaping from within the refrigeration unit.

In accordance with the illustrated embodiments, a ballast can 46 may be either permanently or removably attached to, or integral with, a portion of frame 20. In the view shown in FIG. 2, the difficulty associated with gaining access to a ballast stored in prior art ballast cans can be easily seen. It is difficult to service the ballast can by reaching into the refrigeration unit, around the ballast can and through an opening on the side of the ballast can facing rear wall 38. As discussed in detail below with reference to FIGS. 3–6, this problem in the art may be overcome by, for example, providing a ballast can opening which faces in a direction other than toward the rear or access to a ballast from another direction.

It is to be understood that, in accordance with the present inventions, ballast can 46 may best secured to the frame by any number of means. For example, the ballast can may be attached to the frame through the use of hooks, hangers, screws, nut and bolt arrangements, rivets and other mechanical fastening devices. The ballast can may also be attached through the use of soldering, welding, adhesive bonding, and other similar techniques. Magnetic devices may also be used to secure the ballast can to the frame and, as noted above, frame 20 may be constructed with the ballast can 46 as an integral portion thereof.

Figure 3:
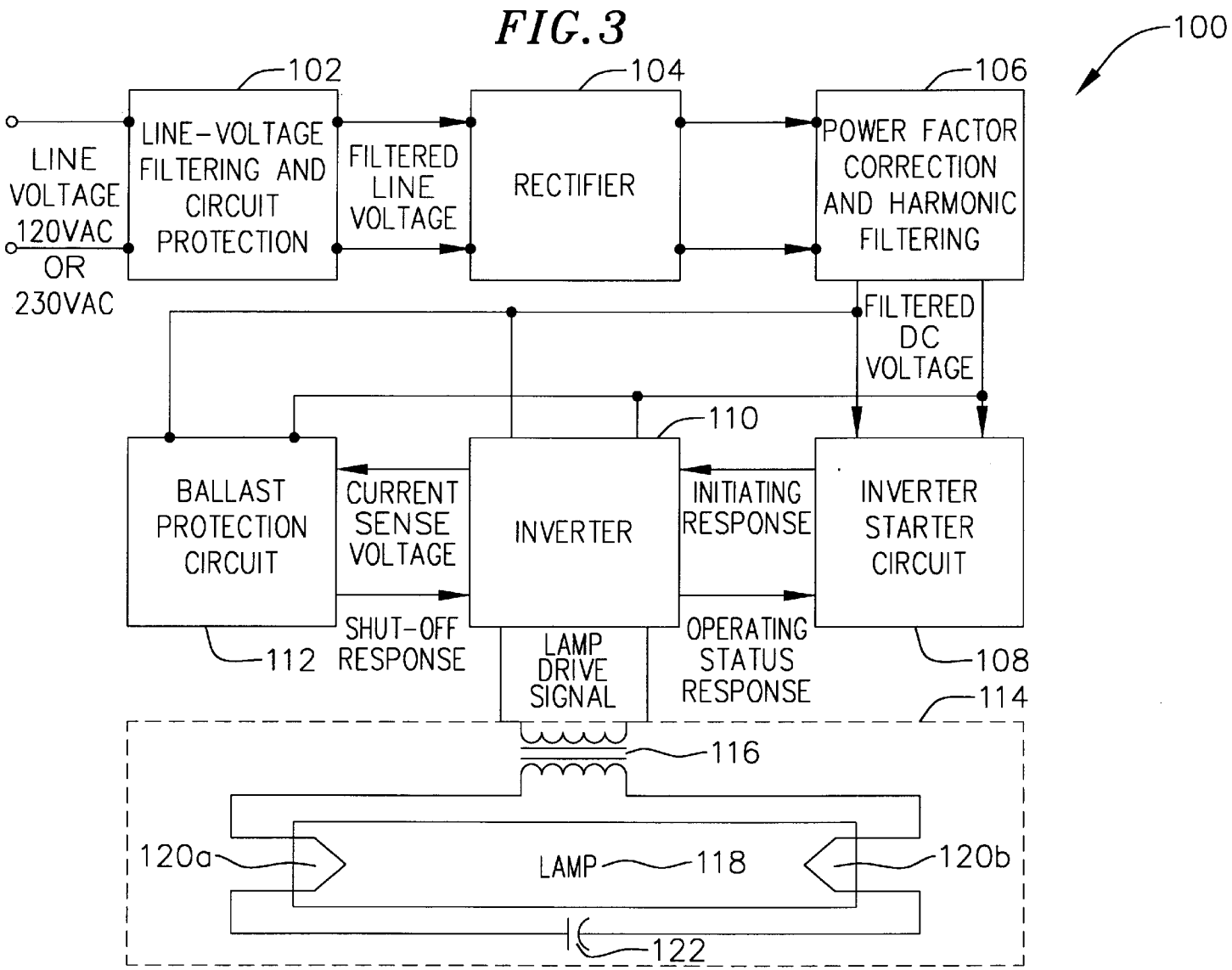
FIG. 3 is a block diagram of a ballast as per another aspect of the invention.

Referring to FIG. 3, a block diagram of the ballast 100 of the invention is shown coupled to a fluorescent lamp circuit 114 for providing thereto the driving current for illuminating the lamp. In the preferred embodiment, the ballast 100 comprises various functional circuits including a line-voltage filtering and circuit protection circuit 102, a rectifier circuit 104, a power factor correction and harmonic attenuation circuit 106, an inverter starter circuit 108, an inverter 110 and a ballast protection circuit 112. The ballast 100 is coupled to the lamp assembly 114 which includes an isolation and impedance-matching transformer 116, the fluorescent lamp 118, or more generally, an electric discharge lamp, and a starting capacitor 122.

The line-voltage filtering and circuit protection circuit 102 of the ballast 100 is used for filtering out noise that may be present in the line-voltage or produced by the ballast 100 itself. Such noise may include high-frequency noise or any other signals not part of the standard line-voltage being received. In the preferred embodiment, the standard line-voltage is 120 or 230 vac, 60 Hz. In addition, any noise that is generated by the ballast circuit is also filtered-out in order to prevent it from leaking out to the line-voltage. The line-voltage filtering and circuit protection 102 also provides protection to the ballast circuit against voltage surges, transients, voltage spikes, start-up surges and other unwanted noise that may cause damage to the ballast circuit.

The rectifier 104 and power factor correction and harmonic attenuation circuit 106 of the ballast 100 is used mainly for converting the filtered line-voltage generated at the output of the line-voltage filtering and circuit protection circuit 102 into a filtered DC voltage for use by the ballast circuit as a source of power. The power factor correction correction and harmonic attenuation circuit 106, as the name suggest, provides line-voltage power factor correction correction in order to increase the efficient use of real power by the ballast 100. In addition, the power factor correction and harmonic attenuation circuit 106 also provides for line-voltage harmonic attenuation, low and high frequency filtering and also filtering of incoming line pulses and energy fed back from the lamp circuit 114. Therefore, the power factor correction and harmonic attenuation circuit 106 outputs a filtered-DC voltage for use by the other elements of the ballast circuit, such as the inverter starter circuit 108, inverter 110 and the lamp protection circuit 112.

The inverter 100 of the ballast 100 produces the driving current for use by the lamp circuit 114 for continuously illuminating the fluorescent lamp 118. The driving current is preferably an oscillating square-wave of sufficient current and voltage for causing the fluorescent lamp 118 to continuously illuminate the lamp. As it will be explained in more detail later, the inverter 108 is generally an oscillating circuit preferably formed of a couple of transistors in a push-pull configuration and including a feedback circuit for creating the oscillating lamp drive current.

The inverter starter circuit 108 of the ballast 100 initiates the inverter 110 to start oscillating so that the oscillating lamp drive current is produced. The inverter starter circuit 108 initiates the oscillating of the inverter 110 by first determining whether the inverter 110 is oscillating by sensing an oscillating sense voltage. If the oscillating sense voltage is not present, meaning that the inverter 110 is not oscillating, the inverter starter circuit 108 produces an initiating pulse that is transmitted to one of the transistors of the inverter in order to cause them to oscillate. During start-up and during times when the inverter 110 stops oscillating for any of a number of reasons, the inverter starter circuit 108 will attempt to initiate the inverter 110 to oscillate.

The ballast protection circuit 112 of the ballast 100 protects the ballast circuitry, and specifically the inverter 110, from damage due to abnormal operations of the lamp circuitry 114. As discussed earlier, some abnormal operations of the lamp circuitry may be due to the aging of the fluorescent lamp 118 or the lamp becoming deactivated. In either case, the effects of such abnormal operations of the lamp circuit 114 on the ballast 100 is that the lamp drive current generated by the inverter 110 increases substantially. As a result, the inverter components, specifically the pair of push-pull transistors, heats up and potentially are damaged.

In order to prevent such damage to the inverter 110, the ballast protection circuit 112 continuously monitors the lamp drive current during the operation of the inverter. If the ballast protection circuit 112 determines that the lamp drive current exceeds a predetermined level, then it stops the inverter 110 from generating the lamp drive current, thereby, preventing the inverter components from over heating, and consequently, from incurring any damages. As will be discussed in more detail later, the ballast protection circuit 112 monitors the lamp drive current by sensing a voltage across a reference resistor situated in the path of the current. This voltage is designated herein as the current sense voltage. In response to excessive current level conditions, the ballast protection circuit 112 produces a "shut-off" response that prevents the inverter 110 from generating the lamp drive current.

The ballast 110 is coupled to the fluorescent lamp circuit 114 initially by way of an isolation and impedance matching transformer 116. Specifically, the inverter 110 of the ballast 100 has an output coupled in series with the primary winding of the transformer 116 for which the lamp drive current is applied to. The secondary winding of the transformer 116 is connected across the lamp 118 by way of the lamps' filaments 120*a–b*. A starting capacitor 122 is also connected across the lamp 118 also by way of the filaments 120*a–b*. The starting capacitor 112 allows current to flow through the lamp filaments 120*a–b* to heat them up during starting conditions so that the lamp gas is able to ignite and generate current through the lamp 118.

Figure 4:
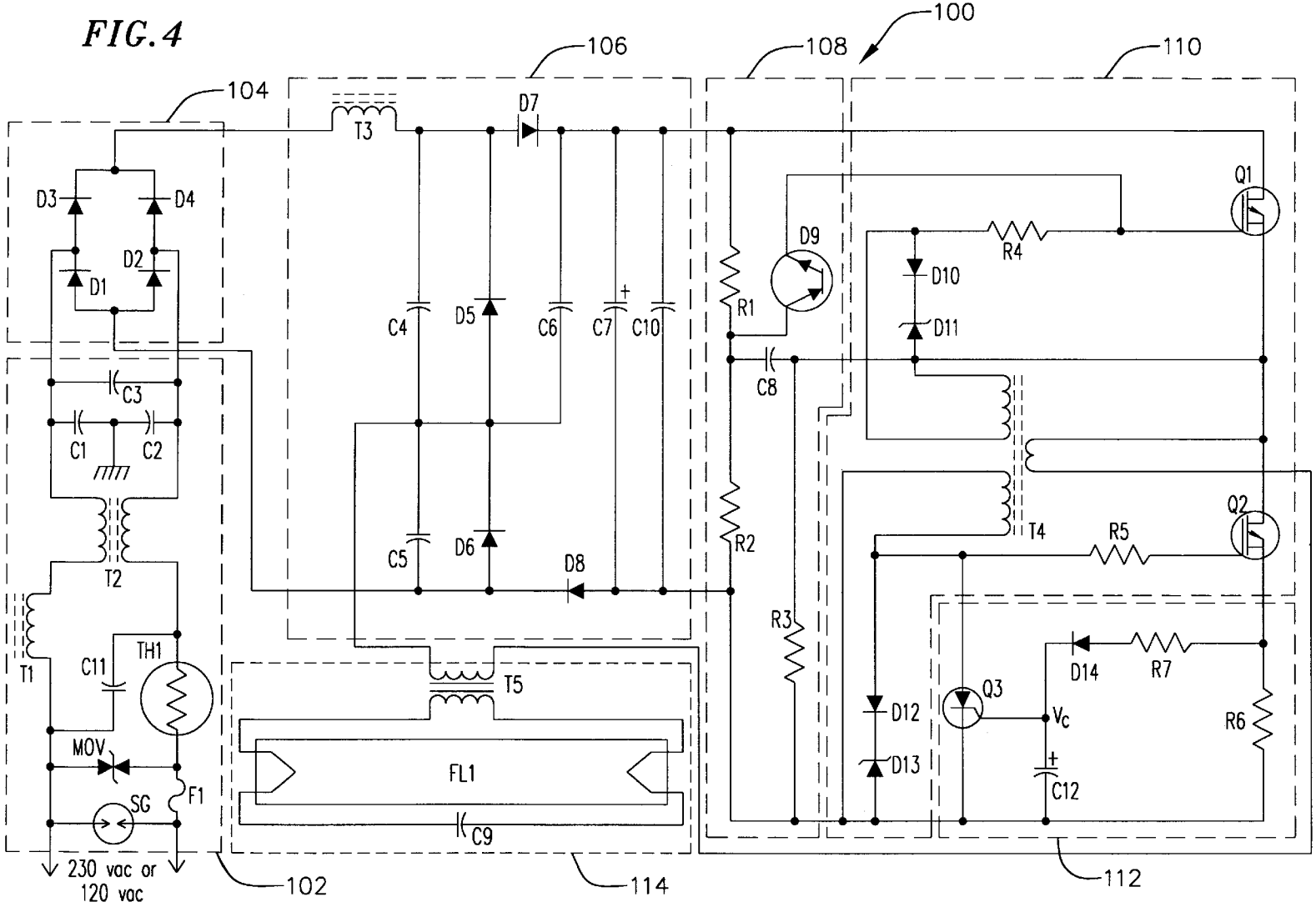
FIG. 4 is a schematic diagram of a ballast as per yet another aspect of the invention.

Referring now to FIG. 4, a component-level schematic diagram of the ballast 100 of the invention is shown. Although component-wise the ballast 100 is shown to be an integrated unit, which is the preferred manner of manufacturing it, the components may be grouped into the different functional blocks described in FIG. 2, namely the line-voltage filtering and circuit protection 102, the rectifier 104, the power factor correction and harmonic attenuation 106, the inverter starter circuit 108, the inverter or oscillator 110 and the ballast protection circuit 112. As shown in FIG. 3, the ballast is coupled to a fluorescent lamp circuit 114.

The line-voltage filtering and circuit protection portion 102 of the preferred form of the ballast 100 comprises an input, a spark gap protection device (SG), a fuse (Fi), a metallic oxide varister (MOV), a thermistor (TH1), chokes (T1–2), and capacitors (C1–3 and C11). The spark gap protection device (SG) is connected across the incoming line-voltage (120 or 230 vac) and provides protection to the ballast 100 against excessive voltage spikes that may be present in the line-voltage. Specifically, if an excessive voltage spike is present in the line-voltage, the spark gap protection device (SG) shorts to ground which prevents the spike from further propagating into the ballast circuit, which can cause damages to its components. The fuse (F1) is connected in series with the line-voltage to prevent excessive current into the ballast circuit, as it is conventionally known.

The metallic oxide varister (MOV) of the line-voltage filtering and circuit protection 102 of the ballast 100 is connected across the line-voltage (120 or 230 vac) and provides protection to the ballast circuitry against transients that may be present in the line-voltage. The negative-temperature coefficient thermistor (TH1) is connected in series with the line-voltage and provides protection to the ballast circuitry against start-up surges. Specifically, during start-up conditions when thermistor (TH1) is at ambient temperature, it exhibits a resistance of about 50 Ohms. After the temperature of the thermistor (TH1) has increase after start-up, the thermistor exhibits a resistance of about 1 to 2 Ohms. The relatively large resistance of the thermistor (TH1) at start-up conditions provides protection to the ballast circuitry against start-up current surges.

The capacitor C11 connected across the line-voltage (120 or 230 vac) and the choke (T1) connected in series with the line-voltage provides filtering out or damping of noise present in the line-voltage, such as high-frequency noise, from propagating into the ballast circuitry. In addition, capacitor (C11) and choke (T1) also provides filtering out or damping of noise created by the ballast circuitry so that the noise does not propagate to the line-voltage. Choke T2 is a common mode choke for filtering of common mode noise generated by the ballast circuit; that is, it isolates the line-voltage, noise-wise, from the internal circuitry of the ballast 100. Capacitors C1 and C2 are provided for filtering out of common mode noise and C3 is provided for filtering out differential line noise.

The output of the line-voltage filtering and circuit protection 102 is taken across capacitor C3 and provides a filtered line-voltage to the rectifier circuit 100 of the ballast 100, as shown in FIG. 3. The rectifier circuit 100 is preferably a conventional full-wave rectifier comprised of diodes D1–4 connected in a conventional rectifying bridge manner. The diodes D1–4 should be chosen so that it can handle the line-voltage that is applied to it, as it is conventionally done. Although a full-wave rectifier is preferred, it shall be understood that other rectifying configurations may be used, such as for example, a half-wave rectifier or the like.

The output of the rectifier circuit 100 which provides a line-voltage at twice the frequency, in this case 120 Hz, is coupled to a power factor correction and harmonic attenuation portion 106 of the ballast. The power factor correction and harmonic attenuation 106 comprises a choke (T3), capacitors (C4–C7, and C10) and diodes (D5–D8). As the name suggests, the power correction and harmonic attenuation 106 increases the power factor correction as seen by the line-voltage received in order to increase the efficient use of the real power. In the preferred embodiment, a power factor correction of about 0.98 has been achieved. Also as the name suggests, the power correction and harmonic attenuation 106 provides for filtering out of the line-voltage harmonics. Specifically, capacitor C7 provides for lower5 frequency harmonic and noise filtering and capacitor C10 provides for higher-frequency harmonic and noise filtering. In the preferred embodiment, the capacitor C10 is preferably a metallized polypropylene (MPP) which is particularly useful for high-frequency filtering. Also, in the preferred embodiment, a power harmonic distortion of about 10 percent has been achieved.

The output of the power correction and harmonic attenuation portion 106 of the ballast 100 taken across capacitor C10 provides a filtered DC voltage to the inverter starter circuit 108, the inverter 110 and the ballast protection circuit 112 for use in performing their functions. The inverter starter circuit 108 includes resistors R1–3, capacitor C8 and diac D9. As discussed above, the purpose of the inverter starter circuit 108 is to sense whether the inverter 110 is generating the lamp drive current, and to cause the inverter to start generating the lamp drive current if it senses that the inverter is off.

In operation, during start-up condition when the inverter 100 is off, the filtered DC voltage applied to capacitor C8 and resistor R3 by way of voltage-divider resistors R1 and R2, causes the capacitor to charge up to a specific voltage. This specific voltage is also applied across to the diac D9. When this voltage exceeds a certain level depending on the characteristic of the diac D9, the diac begins conducting for a short time. This action provides a voltage pulse to transistor Q1 of the inverter 110 which starts the inverter oscillating. During oscillation of the inverter, the apparent voltage across the diac is relatively small. If the inverter 110 ceases to oscillate, the voltage across the diac D9 increases, and thereby causes the diac to again conduct for a brief time. This action sends another voltage pulse to transistor Q1 for attempting to re-start the oscillation of the inverter 110. Although the inverter starter circuit 108 is shown connected to the gate of transistor Q1, it shall be understood that it can be configured to perform the inverter starting function by way of the base of transistor Q2.

As discussed earlier, the inverter 110 generates the lamp drive current for causing the continuous illumination of the fluorescent lamp 118. Preferably, the inverter 110 is an oscillating circuit comprising a pair of series-connected transistors Q1 and Q2 configured in a push-pull manner. The inverter 110 further includes a feedback transformer T4 having a primary winding coupled to the output of the inverter (the output of the inverter being the electrically-connected source (S) of transistor Q1 and drain (D) of transistor Q2). The feedback transformer T4 also includes a pair of secondary windings that are wound in opposite directions so that their respective voltages are 180 degrees out-of-phase. The inverter 110 further includes a pair of resistors R4 and RS connected to the gates of transistors Q1 and Q2, respectively, for optimally tuning the inverter 110 by adjusting the phase of the current applied to the gates of the transistors. The resistors R4 and R5 also help in preventing transistors Q1 and Q2 to go into an oscillatory mode. Associated with each transistor in the inverter 110 are diodes (D11 for Q1 and D12 for Q2) and Zener diodes (D11 for Q1 and D13 for Q2) connected in series across respective secondary windings of the feedback transformer T4. The purpose of the series-connected diode and Zener diode is to limit the voltage applied to the gate of each transistor for protection of the gates. The Zener diodes clamp the gate voltage if it exceeds a certain level depending on the threshold voltage of the Zeners.

In operation, during start-up conditions or other conditions where the inverter 110 is off, that is both transistors Q1 and Q2 are off, the inverter starter circuit 108 provides a voltage pulse to transistor Q1 which allows it to conduct current between its drain (D) and source (S). The primary winding of the feedback transformer T4 senses this rise in drain current of transistor Q1 and induces an voltages on its respective secondary windings. The voltage induced in the secondary winding that is coupled to the gate of transistor Q2 is relatively high, which forces transistor Q2 to conduct. The voltage induced in the secondary winding that is coupled to the gate of transistor Q1 is relatively small, which forces transistor Q2 to stop conducting. Now the drain current of Q2 rises which causes the feedback transformer T4 to induce a voltage in the secondary winding associated with transistor Q1 that causes it to conduct, and induces another voltage in the secondary winding associated with transistor Q2 that causes it to stop conducting. This process is repeated to produce a lamp drive current that oscillates. In the preferred embodiment, the transistors Q1 and Q2 should be configured so that they do not operate in their linear region. In other words, they should be operated in either their full-conducting or non-conducting modes.

The output of the inverter 110 is connected in series with the primary winding of transformer T5 of the fluorescent lamp circuit 114. Therefore, the lamp drive current generated by the inverter 110 is coupled to the fluorescent lamp FL1 by way of transformer T5. Transformer T5 serves at least a couple of purposes. First, it provides isolation between the inverter 110 and the fluorescent lamp FL1. It also serves as an impedance matching device for matching the impedance of the output of inverter 110 with the impedance of the fluorescent lamp FL1. The secondary of transformer T5 is connected across the fluorescent lamp FL1 for applying the lamp drive current thereto by way of the lamp filaments 120*a–b*.

As discussed earlier, there may be situations where the fluorescent lamp FL1 operates at abnormal conditions. These abnormal conditions, for example, can be due to aging or lamp deactivation. During these abnormal lamp conditions, the resistance of the lamp FL1 substantially increases due to the lack of current conduction therethrough. As a result, the load as seen by the output of the inverter 110 is essentially a high-Q LC resonant circuit having relatively low impedance. This low impedance load causes the inverter to generate a relatively large current which causes heat to build up in transistors Q1 and Q2, and possibly other components, which may damage these devices.

Therefore, to protect the ballast 100, and especially the inverter 110 from damage due to abnormal lamp conditions, the ballast 100 includes a ballast protection circuit 112. As discussed earlier, functionally, the ballast protection circuit 112 monitors or senses the current of the lamp drive current, and if it determines that the current exceeds a predetermined level, it causes the inverter 110 to stop generating the lamp drive current; thereby, preventing the transistors Q1 and Q2 or other components from excessive current that may damage them.

Specifically, the preferred embodiment of the ballast protection circuit 112 includes a sensing circuit and a response or trigger circuit. In the preferred embodiment, the trigger takes the form of silicon controlled rectifier (SCR Q3) or similar device. The sensing circuit is preferably R6, and the protection circuit may also include delay components such as one or more of diode D14, resistors R7, and capacitor C12. The resistor R6 is connected in series with transistor Q2, and accordingly, develops a voltage across it that is proportional or directly related to the lamp drive current. Resistor R6 is therefore termed a current sensing resistor and the voltage across it is a current sensing voltage. A series path comprising of resistor R7, diode D14 and capacitor C12 is connected across the current sensing resistor R6 which provides the current sense voltage to the control terminal of the SCR Q3. The cathode and anode of the SCR Q3 is connected across the gate (G) and the source (S) of Q2 by way of resistors R5 and R6.

In operation, during normal operations of the ballast 100 where no abnormal lamp conditions are present, the current sense voltage across the current sense resistor R6 is below the trigger level of the SCR Q3. In other words, the resistance of the current sensing resistor R6 is such that during normal levels of the lamp drive current, the current sense voltage developed across the current sense resistor R6 is lower than the trigger level of the SCR Q3 (ignoring the 0.7 Volt drop across the diode D14, for the purpose of this explanation). When abnormal lamp conditions occur, the lamp drive current may increase to a level that results in a current sense voltage applied to the control terminal of the SCR Q3 that exceeds its trigger level. In other words, the resistance of the current sensing resistor R6 is such that during abnormal levels of the lamp drive current, the current sense voltage developed across the current sense resistor R6 is above the trigger level of the SCR Q3.

When the trigger voltage of the SCR Q3 is exceeded during abnormal lamp conditions, the SCR Q3 conducts, and consequently, forces down the voltage applied to the gate of transistors Q2, or alternatively, shunts the gate of transistor Q2. As a result, transistor Q2 ceases to conduct, which consequently stops the inverter 110 from oscillating.

Although the ballast protection circuit 112 is set up for causing transistor Q2 to cease conducting when abnormal lamp conditions occur, it shall be understood that the ballast protection circuit 112 can be configured in a similar manner to prevent transistor Q1 from conducting when abnormal lamp conditions occur. There may be even situations where it is desirable to provide a ballast protection circuit 112 for each of the transistors Q1 and Q2.

The capacitor C12 of the ballast protection circuit 112 is used for affecting the timing of when the ballast protection circuit is activated after an abnormal lamp condition occurs. More specifically, during an abnormal lamp condition, the current sense voltage across the current sense resistor R6 will increase due to the increase in the lamp drive current, as explained above. The control input of the SCR Q3 will not sense this increase in the current sense voltage immediately, since the capacitor C12 will take some time (time-constant) to charge up. When the capacitor C12 charges up to the trigger voltage of the SCR Q3, the SCR Q3 will conduct and cause the inverter 110 to shut off. This delay in the activation of the ballast protection circuit 112 after an abnormal lamp condition occurs can be termed herein as the "protection activation delay."

The protection activation delay of the ballast protection circuit 112 is useful during start-up conditions. During start-up conditions, or often termed a "cold lamp condition", current conduction within the fluorescent lamp FL1 does not occur immediately, and therefore, the lamp FL1 looks like a high-Q low impedance load to the output of the ballast 100. As a result, the ballast 100, upon start-up, will produce a relatively large current in order to cause ionization of the lamp gas so that current conduction can occur within the lamp. To the ballast protection circuit 112, this initial in-rush of current to the lamp FL1, looks like an abnormal lamp condition since the current sense voltage across the current sense resistor R6 will be of sufficient size to cause the ballast protection circuit to activate. Thus, without the protection activation delay, the ballast protection circuit 112 might otherwise always activate on start-up condition, and cause the inverter 110 to shut-off on start-up.

Because of the protection activation delay due to capacitor C12, the ballast protection circuit 112 allows sufficient time for normal current conduction within the fluorescent lamp FL1 to occur before the ballast protection circuit is activated. Therefore, there is no problem of the inverter 110 being shut off permanently before the fluorescent lamp FL1 is illuminated. Generally, it only takes a few cycles of the lamp drive current to cause normal current conduction within the fluorescent lamp FL1. Therefore, the protection activation delay of the ballast protection circuit 112 should be sufficient to allow normal current conduction of the lamp FL1. In the preferred embodiment, the protection activation delay is approximately 4 milli-seconds, whereas the frequency of the lamp drive current is around 42 to 62 KHz, which provides for about a little over 10 periods of the lamp drive current to occur before the ballast protection circuit 112 activates.

In addition, it is also desirable for the ballast protection circuit 112 not to activate immediately when the current sense voltage indicates an abnormal lamp condition. This is because there may be times when fast transients, surges or spikes present at the output of the inverter 110 cause the current sense voltage to indicate that an abnormal lamp condition has occurred. It is not necessarily desirable for the ballast protection circuit 112 to activate and cause the inverter 110 to shut-off each time there is a fast transient, surge or spike at the output of the inverter 110.

The capacitor C12 of the ballast protection circuit 112 also provides an additional timing function useful for the ballast 100. Specifically, after an abnormal lamp condition occurs which causes the ballast protection circuit 112 to activate and shut-off the inverter 110, the lamp drive current decreases to nil after the ballast protection circuit 112 causes the inverter 110 to shut off. This results in a current sense voltage across current sense resistor R6 that decreases to nil. Therefore, without the capacitor C12, the voltage applied to the control terminal of the SCR Q3 could also decrease immediately to nil, which could de-activate the ballast protection circuit 112. In the meantime, the inverter starter circuit 108, after shut-off of the inverter 110, attempts to re-start the inverter 110 by providing voltage pulses to the gate of the transistor Q1, as explained above. Therefore, if capacitor C12 were not present, the inverter 110 could almost start immediately or a short time after an abnormal lamp condition has activated the ballast protection circuit. Thus, it may be desirable not to restart the inverter 110 immediately after shut-off from an abnormal lamp condition, to allow some time for the abnormal lamp condition or the effects thereof to possibly dissipate.

Thus, the capacitor C12 of the ballast protection circuit 112 allows for the voltage at the control terminal of the SCR Q3 to slowly dissipate to keep the ballast protection circuit activated a pre-determined time so that the inverter 110 does not immediately re-start. This allows for possibly the abnormal lamp condition to dissipate, if that is possible. The diode D14 prevents voltage on capacitor C12 to dissipate through R6 and R7 in order to provide a sufficient delay in the de-activation of the ballast protection circuit. This delay can be termed herein as the "protection de-activation delay."

Figure 5:
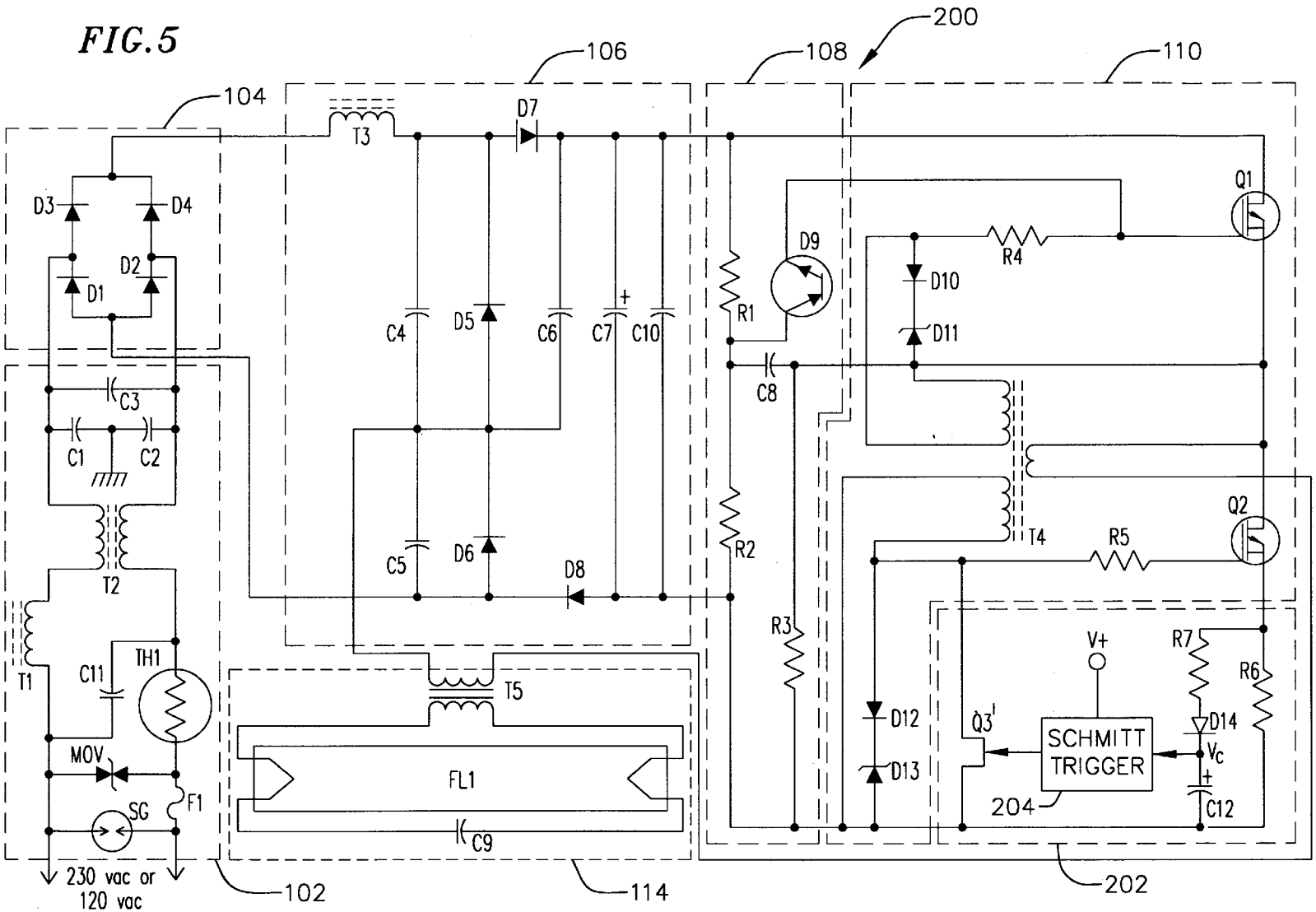
FIG. 5 is a schematic diagram of a ballast as per even another aspect of the invention.

Referring now to FIG. 5, a schematic diagram of a ballast circuit 200 is shown as per another aspect of the invention. The ballast 200 is similar to that of ballast 100, and therefore, similar elements will be denoted with the same reference numbers. Ballast 200 includes a ballast protection circuit 202 that is a variant of ballast protection circuit 112. The ballast protection circuit 200 includes a current sense resistor R6 which produces a current sense voltage across it that is proportional or related to the lamp drive current of the output of the ballast 100. Circuit 200 further includes a series-path connected across the current sense resistor R6 comprised of resistor R7, diode D14, and capacitor C12. All these components, namely resistors R6 and R7, diode D14, and capacitor C12 serve substantially the same functions as the same components of the ballast protection circuit 112 of FIG. 3. Therefore, attention is directed to the detailed functional discussion of FIG. 3 above.

The ballast protection circuit 202 differs from protection circuit 112 in that instead of the SCR Q3 used for shunting the gate of transistor Q2 in order to shut-off the inverter 110, it uses a conventional metal oxide field effect transistor (MOSFET) Q3' to perform a shunting function. The concern with the use of MOSFET Q3' is that it tends to go into its linear operation if the voltage at its gate is not above its trigger level for given circuit conditions. If MOSFET Q3' operates in the linear region, it may cause transistors Q1 and Q2 also to operate in the linear regions, which would cause an undesirable operation of the inverter 110.

Therefore, in order to prevent the MOSFET Q3' to operate in its linear region, a Schmitt trigger 204 is provided having an input coupled to the capacitor C12 for receiving therefrom the current sense voltage Vc, and an output coupled to the gate of the MOSFET Q3'. In operation, when the current sense voltage Vc is below the threshold voltage of the Schmitt trigger 204 (that is, under normal lamp drive current conditions or ballast off condition), the Schmitt trigger outputs about a zero voltage to the gate of the MOSFET Q3'. Therefore, the MOSFET Q3' does not conduct, and consequently, the ballast protection circuit 202 remains de-activated. When an abnormal lamp condition occurs, the current sense voltage Vc rises to above the threshold level of the Schmitt trigger 204. When this occurs, the Schmitt trigger 204 produces an output voltage that is. applied to the gate of the MOSFET Q3' that causes it to go into saturation. At saturation, the MOSFET Q3' fully conducts and shunts the gate of transistor Q2, thereby shutting-off the inverter 110. Thus, the ballast protection circuit 202 is activated.

Figure 6:
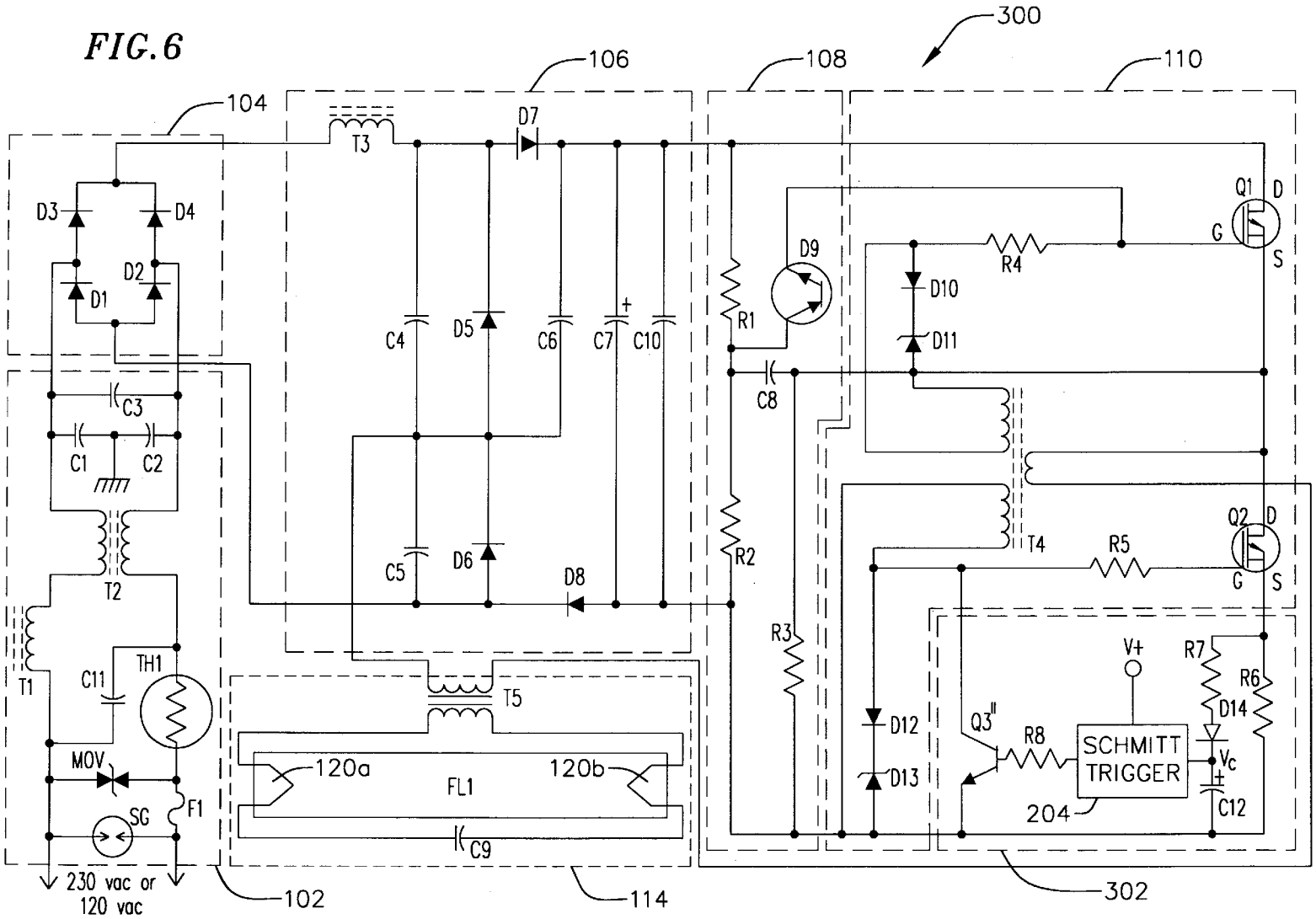
FIG. 6 is a schematic diagram of a ballast as per still another aspect of the invention.

Referring now to FIG. 6, a schematic diagram of a ballast 300 as per yet another embodiment of the invention is shown. The ballast 300 is similar to ballast 200, but it includes a ballast protection circuit 302 that is a variant of ballast protection circuit 202. Instead of using a MOSFET Q3' for achieving the shunting of the transistor Q2 of the inverter 110 for the purpose of shutting-off the inverter, a bipolar transistor Q3" is used to perform the same function. A resistor R8 is provided between the output of the Schmitt trigger 204 and the base of the bipolar transistor Q3".

The operation of the ballast protection circuit 302 functions similar to that of protection circuit 202 in that a current sense voltage $V_C$ below the threshold level of the Schmitt trigger 204 causes the Schmitt trigger to output a voltage near zero. This zero or low voltage (preferably below 0.7 Volts) is applied to the base of the bipolar transistor Q3" which fails to cause the transistor Q3" to conduct. When the current sense voltage $V_C$ is above the threshold level of the Schmitt trigger 204, it causes the Schmitt trigger 204 to output a voltage sufficient to cause the bipolar transistor Q3" to go into saturation. At saturation, the bipolar transistor Q3" fully conducts and shunts the gate of transistor Q2, thereby shutting-off the inverter 110. Thus, the ballast protection circuit 302 is activated.

There may be other devices, other than SCR Q3, the MOSFET Q3', and the bipolar transistor Q3" that can be used for shunting the transistor Q2 of the inverter 110, or more generally, for causing the inverter 110 to stop generating the lamp drive current or otherwise change the output to the lamp. Such devices would use a controllable conduction path that is responsive to the current sense voltage developed across the current sense resistor R6. For example, one other device is an opto-isolator. The advantage of the opto-isolator is that it can be implemented without a ground reference. Therefore, it may be employed in different areas of the ballast for use in sensing an abnormal lamp drive current.

The advantage of the ballast protection circuits 112, 202 and 302 of the invention is that they require relatively few parts. Whereas the prior art ballast protection circuits are more complex, including relatively large component count number, and more intricate manner of sensing an abnormal lamp condition. The relatively small part-count for the ballast protection circuits of the invention translates into a less expensive ballast because fewer parts and, accordingly, less labor, are required. From a time standpoint, fewer parts translates into less time to manufacture the ballast. In addition, fewer parts also translates to a statistically more reliable ballast.

Appendix A included herewith includes the preferred component specifications for the ballasts 100, 200 and 300 for two different types of lamps and for two different line voltages. More specifically, page 1 of Appendix A lists the preferred component specification of the ballasts for driving a 28 watt, T5 size fluorescent lamp (F28T5) for a line voltage of 120 vac. Page 2 of Appendix A lists the preferred component specification of the ballasts for driving a 28 watt, T5 size fluorescent lamp (F28T5) for a line voltage of 230 vac. Page 3 of Appendix A lists the preferred component specification of the ballasts for driving a 32 watt, T8 size fluorescent lamp (F32T8) for a line voltage of 120 vac. And, page 4 of Appendix A lists the preferred component specification for a 32 watt, T8 size fluorescent lamp (F32T8) for a line voltage of 230 vac.

Although the present invention has been described in detail regarding the exemplary embodiments and drawings thereof, it should be apparent to those skilled in the art that various adaptations and modifications of the present invention may be accomplished without departing from the spirit and scope of the invention. Accordingly, the invention is not limited to the precise embodiments shown in the drawings and described in detail in hereinabove.

What is claimed is:

1. A ballast circuit comprising:

an output circuit for producing a lamp drive current used for driving an electric discharge lamp; and a ballast protection circuit for protecting the output circuit from excessive lamp drive current, comprising:

a current sensing resistor for producing across it a current sense voltage that varies as a function of the lamp drive current, and a device responsive to said current sense voltage for preventing said output circuit from producing said lamp drive current when said current sense voltage reaches a predetermined voltage range indicative of excessive lamp drive current wherein said voltage-responsive device includes a device having a controllable conduction path responsive to said current sense voltage, said controllable conduction path coupled to the gate and source of a first effect transistor for shunting said gate and source of said transistor when said current sense voltage is within said pre-determined voltage range, thereby causing said inverter from generating said oscillating lamp drive current; and wherein said output circuit includes said inverter comprising said first field effect transistor and a second field effect transistor in a push-pull configuration including a feedback device for causing said inverter to generate an oscillating lamp drive current.

2. The ballast circuit of claim 1, wherein said voltage-responsive device includes one of the devices of the group of devices comprising a silicon control rectifier, a MOSFET, a bipolar transistor and an opto-isolator.

3. The ballast circuit of claim 1, wherein the ballast protection circuit includes a first delay circuit for providing a first delay in the preventing of said output circuit from producing said lamp drive current when the current sense voltage initially indicates said excessive lamp drive current.

4. The ballast circuit of claim 3, wherein the first delay circuit includes a timing capacitor coupled in series with a timing resistor used for delaying the activation of the voltage responsive device.

5. The ballast circuit of claim 4, wherein said voltage-responsive device is coupled to said first delay circuit for receiving therefrom said current sense voltage.

6. The ballast circuit of claim 3, wherein said first delay is longer than the time it takes for illuminating current to begin conducting within said electric discharge lamp after the lamp drive current is initially applied to said lamp.

7. The ballast circuit of claim 1, wherein said voltage-responsive device is a silicon controlled rectifier, bipolar transistor and a MOSFET.

8. A ballast circuit comprising:

an output circuit for producing a lamp drive current used for driving an electric discharge lamp; and a ballast protection circuit for protecting the output circuit from excessive lamp drive current, comprising:

a current sensing resistor for producing across it a current sense voltage that varies as a function of the lamp drive current, a device responsive to said current sense voltage for preventing said output circuit from producing said lamp drive current when said current sense voltage reaches a predetermined voltage range indicative of excessive lamp drive current, and a first delay circuit for providing a first delay in the preventing of said output circuit from producing said lamp drive current when the current sense voltage initially indicates said excessive lamp drive current, wherein the first delay circuit includes a timing capacitor coupled in series with a timing resistor used for delaying the activation of the voltage responsive device and a diode coupled in series with said timing capacitor and timing resistor for providing a second delay in the ballast protection circuit for delaying the prevention of said lamp drive current when said current sense voltage changes from being within said predetermined voltage range to being not within said predetermined voltage range.

9. A ballast circuit comprising:

an output circuit for producing a lamp drive current used for driving an electric discharge lamp; and a ballast protection circuit for protecting the output circuit from excessive lamp drive current, comprising:

a current sensing resistor for producing across it a current sense voltage that varies as a function of the lamp drive current, and a device responsive to said current sense voltage for preventing said output circuit from producing said lamp drive current when said current sense voltage reaches a predetermined voltage range indicative of excessive lamp drive current;

wherein said output circuit includes an inverter comprising first and second field effect transistors in a push-pull configuration including a feedback device for causing said inverter to generate an oscillating lamp drive current; and an inverter starter circuit for producing a starting pulse that is applied to the gate of said first field effect transistor for causing the inverter to start producing said oscillating lamp drive current.

10. A method of protecting a ballast circuit from generating a lamp drive current that is excessive, comprising:

sensing a current sensing voltage across a current sensing resistor that varies as a function of the lamp drive current;

preventing the ballast circuit from generating said lamp drive current if the current sensing voltage is within a predetermined voltage range indicating that an excessive lamp drive current exists and wherein the step of preventing the ballast circuit from generating said lamp drive current includes the step of shunting the gate voltage of a lamp drive current generating field effect transistor in order to prevent the operating of said transistor.

11. The method of claim 10, further including the step of delaying the preventing of the ballast circuit from generating the lamp drive current for a predetermined time so that the starting of an electric discharge lamp does not prevent the ballast circuit from generating the lamp drive current.

12. The method of claim 10, further including the step of not preventing the ballast circuit from generating the lamp drive current when the current sense voltage changes from being within said predetermined voltage range.

13. The method of claim 12, further including the step of delaying the not preventing of the ballast circuit from generating the lamp drive current for a predetermined time.

14. The method of claim 10, wherein the step of shunting the gate voltage of said field effect transistor includes using one of a silicon controlled rectifier, bipolar transistor, MOSFET and opto-isolator to perform said shunting.

* * * * *